United States Patent [19]

Gheysens

[11] Patent Number: 4,973,336

[45] Date of Patent: Nov. 27, 1990

[54] FUEL ADDITIVES

[76] Inventor: Jean-Louis G. Gheysens, 6088D Joaquim Murieta Ave., Newark, Calif. 94560

[21] Appl. No.: 393,854

[22] Filed: Aug. 11, 1989

Related U.S. Application Data

[63] Continuation of Ser. No. 205,162, Jun. 10, 1988, abandoned.

[51] Int. Cl.[5] ..... C10L 1/18; C10L 1/22

[52] U.S. Cl. ..... 44/331; 44/363; 44/364; 44/317; 44/426; 44/406

[58] Field of Search ..... 44/70, 72, 66, 71, 77

[56] References Cited

U.S. PATENT DOCUMENTS

| | | | |
|---|---|---|---|
| 3,275,554 | 9/1966 | Wagenaar | 252/50 |
| 3,387,954 | 6/1968 | Capowski et al. | 44/72 |
| 3,438,757 | 4/1969 | Honnen et al. | 44/63 |
| 3,454,381 | 7/1969 | Eckert | 44/66 |
| 3,454,555 | 7/1969 | vander Voort et al. | 44/72 |
| 3,565,804 | 2/1971 | Honnen et al. | 44/72 |
| 3,624,115 | 11/1971 | Otto et al. | 44/72 |
| 3,639,109 | 2/1972 | Badin | 44/66 |
| 3,717,446 | 2/1973 | Howland et al. | 44/72 |
| 3,960,965 | 6/1976 | Battersby et al. | 44/72 |
| 3,969,253 | 7/1976 | Poklacki | 44/72 |
| 4,136,043 | 1/1979 | Davis | 252/47.5 |
| 4,230,588 | 10/1980 | Bonazzi et al. | 44/66 |
| 4,448,586 | 5/1984 | Weidig | 44/66 |
| 4,505,718 | 3/1985 | Dorer, Jr. | 44/66 |
| 4,549,882 | 10/1985 | Knapp | 44/72 |
| 4,565,547 | 1/1986 | Takada | 44/72 |
| 4,695,293 | 9/1987 | Kessler | 44/72 |
| 4,737,159 | 4/1988 | Phillips | 44/72 |

*Primary Examiner*—Olik Chaudhuri
*Assistant Examiner*—E. McAvoy
*Attorney, Agent, or Firm*—Limbach, Limbach & Sutton

[57] ABSTRACT

A composition for the improvement of hydrocarbon fuel as exhibiting a boiling range of gasoline. The composition comprises an amine, a polyaminated detergent, a phenylamine diamine inhibited aromatic monomer stabilized by a polymeric substrate, a catalyst, a solvent, a promotor, alternative promoter and co-promoter. When used collectively, the recited composition has been found to significantly increase the octane of such hydrocarbon fuels while enhancing their anti-knock, anti-icing, anti-oxidency, anti-corrosion, detergency, and combustion properties and providing a lubrication quality to spark ignition-type engines used to burn the hydrocarbon fuels.

43 Claims, No Drawings

FUEL ADDITIVES

This is a continuation of co-pending application Ser. No. 07/205,162 filed on June 10, 1988, now abandon.

TECHNICAL FIELD OF INVENTION

The present invention concerns a novel composition used as an additive to improve the characteristics of hydrocarbon fuels exhibiting a boiling range of gasoline being suitable for use in spark ignition-type engines. Hydrocarbon fuels of this type are those comprising hydrocarbonaceous gasoline fuels, oxygenated gasoline fuel compositions such as gasohol and alcogas and blends of various hydrocarbon components exhibiting boiling points in the range of 65°–430° F. Such additives can also be employed with ethanol, methanol and other oxygenates when blended into hydrocarbons boiling in the gasoline range suitable for use as fuels without adversely affecting the storage stability, oiliness, water shedding properties or corrosion, characteristics of the fuels or their distillation, combustion curve and vapor pressure.

BACKGROUND OF THE INVENTION

Historically, gasoline manufacturers have employed tetraethyl lead as an anti-knock additive for use in hydrocarbon based gasoline fuels. However, as mandated by the environmental protection agency, the maximum amount of lead allowable in gasoline as of Jan. 1, 1986 was but a mere 0.1 grams per gallon. Total removal of lead from gasoline is under consideration. Due to the practice of banking lead credits, many refineries in the United States continue to produce gasoline with more than the 0.1 gram per gallon limit. However, the lead credit process terminated at the end of 1987 thereby increasing the need to find tetraethyl lead alternatives.

There is obvious concern over the need to maintain octane while dropping lead levels in gasoline based fuels. Many industry observers believe that there is a limit to how much extra octane can be squeezed out of such fuels during the refining process and the general belief remains that prices for high octane gasolines at the 92 octane level will soar as demand outstrips supply for such products. The problem has become particularly acute in large part due to the trend of automobile manufacturers to increase horsepower by increasing compression ratios of their internal combustion engines. This necessitates higher octane gasolines to avoid knocking.

It has been known for some time that the octane of motor fuels could be enhanced by varying the thermal and catalytic processes used in the distillation of the hydrocarbon fuels. Octane could also be enhanced by addition of, as previously noted, tetraethyl lead, as well as cyclopentadiene manganese compounds or by blending hydrocarbon fuels with large volumes of aromatics. However, benzene is a known carcinogen and a growing public awareness for the need to create cleaner air will obviously limit the availability of such alternatives.

The virtual elimination of tetraethyl lead as a hydrocarbon fuel additive results in yet another concern and that is the observation that the elimination of tetraethyl lead results in severe engine exhaust valve seat recession. Tetraethyl lead acts as a lubricant for exhaust valve seats for it was noted that without significant quantities of tetraethyl lead in hydrocarbon fuels, wear rates above 0.015 inches per hundred hours of engine operation were observed resulting in a loss of engine compression and ultimate engine failure, sometimes occurring in less than 1,000 hours of engine operation.

In contemplating various additives to improve octane and anti-knock properties of hydrocarbon fuels, care must be taken to avoid deposits which have been found to accumulate on the carburetor throttle plate and intake valves—basically all components from carburation to combustion. Such deposits can cause rough idling, loss of power and even valve burning. Such deposits can account for a substantial increase in the octane requirements of an engine and can require a gasoline octane improvement of 5 to 25 numbers in order to prevent engine knocking.

It is thus an object of the present invention to provide a chemical composition which could be employed to increase the octane of hydrocarbon fuels exhibiting a boiling range of gasoline being suitable for use in spark ignition-type engines while avoiding the shortcomings of the prior art.

It is yet another object of the present invention to provide improved anti-knocking and lubrication characteristics of hydrocarbon fuels exhibiting a boiling range of gasoline being suitable for use in spark ignition-type engines which is environmentally safer than prior alternatives and yet do not result in destructive engine deposits.

These and other objects will be more readily appreciated when considering the following disclosure of the present invention.

SUMMARY OF THE INVENTION

The present invention deals with a composition for the improvement of hydrocarbon fuels exhibiting a boiling range of gasoline being suitable for use in spark ignition-type engines. The composition comprises firstly, an amine comprising a member selected from the group consisting of aliphatic amines, aromatic amines and mixtures thereof. The composition further comprises a polyaminated detergent and, optionally, an alkyl or phenol and/or alkylphenol phenylenediamine inhibited aromatic monomer stabilized by a polymeric substrate. A catalyst should be included comprising a colloidal suspension or amine salt of transition/alkali/alkaline earth metal organic coordinations having at least one metal oxidehydroxide linked to an alkyl chain via a carboxyl group. The composition also includes a solvent comprising an alkanol-aliphatic ether oxygenated hydrocarbon and, optionally, a promoter comprising a member selected from the group consisting of an organic oxide, alone or azeotroped with carbon disulfide with one or more alkanes and, optionally, a co-promoter comprising an organic ester.

As will be more readily apparent in considering the remaining disclosure particularly the various examples, the combination of components comprising the present composition provide, as a group, the enhancement of hydrocarbon fuels far superior to any single component or group of prior components, taken alone.

DETAILED DESCRIPTION OF THE INVENTION

As previously noted, the present invention is directed to a composition for the improvement of hydrocarbon fuels exhibiting a boiling range of gasoline. Such fuels include, but are not limited to, straight-chain and branched-chain, alkanes, olefins, aromatics and napthenes prepared by well-known catalytic processes. It is obviously necessary that the composition of the present invention be soluble as well as stably dispersable in any such hydrocarbon fuel to which it is added.

The composition of the present invention firstly contains an amine and a polyamine also characterized as a polyaminated detergent. These ingredients can comprise preferably between 5 and 85%, and preferably at least 40%, by weight of the entire composition. Further, it is contemplated that the range of amine to polyaminated detergent be, on the one extreme, from 99 parts by weight amine to one part by weight polyaminated detergent to, on the other extreme, two parts by weight polyaminated detergent to one part by weight amine.

It is contemplated that the amine component comprise one or more members selected from the group consisting of aromatic amines; methyl-, trimethyl- and tetramethyl alkylated forms of ethylene diamines; primary alkyl fatty amines; alkylether propylamines; ether diamines; alkylpropylene diamines; methyl-, dimethyl-, trimethyl-, methoxy-, ethyl-, butyl-, propyl-, isobutyl-, fluoro-, chloro-, bromo-, iodo-, difluoro-, dichloro- and diiodo-phenylamines, and mixtures thereof.

It is proposed that the polyamine or polyaminated detergent comprise one or more members selected from the group consisting of polypropylene and polyisobutene succinic polyalkene amines; substituted benzylpolyamines; acylated polyalkene amine-polyolefins; hydrocarbon polyether-substituted succinamic acid compounds; reaction products of polyethers and maleic anhydride; the reaction products of polyethers and asparagine; primary aliphatic hydrocarbon aminoalkene substituted asparagines; ω-N-disubstituted amino alkanoic acid; N'-amides; alkyl and hydroxy-substituted benzylpolyamines and mixtures thereof.

Multicomponent polyaminated detergents for use in the present invention are available from the Lubrizol Corporation as multifunctional dispersant type additives for gasoline available under Lubrizol Component Nos. 8101, 8107, 8150 and 8157A, etc. Various amine-polyamine ashless polymeric dispersants are obtainable from Mobil Corporation, Chevron Chemicals and E. I. duPont deNemours & Co., among others.

The composition next can also include a phenylenediamine, or a phenol, alkyl-phenol phenylenediamine inhibited polymeric substrate. The phenylenediamine, or phenol, alkyl-phenol phenylenediamine acts as an antioxidant and metal deactivator while the polymeric substrate is employed to stabilize the composition against known destabilizing components such as excess maleic anhydride which may be present upon the copolymerization neutralization of the polyamine component. This component is to be incorporated within this composition in an amount between approximately 0 to 1.0% (by weight) and, preferably between approximately 100 ppm to 1000 ppm.

The polymeric substrate comprises one or more polymers prepared from monomers selected from the group consisting of styrene, α-methyl styrene and $C_{1-4}$ alkyl and alkoxy ring substituted styrenes. These include para-methyl styrene, para-sec butyl styrene and para-methoxy styrene.

It is preferred that the polymeric substrate be prepared by combining approximately 60% of a styrene monomer with approximately 15% of partially polymerized styrene monomer in the presence of ethyl benzene preferably pre-blended in either xylene or a coal tar distillate. The alkyl and phenol phenylenediamine components are readily available as anti-oxidants. Typical examples of suitable materials include N,N-disecondary butyl P-phenylene diamine available from E. I. duPont deNemours & Co., Ethyl Corporation and Monsanto, among others.

The composition of the present invention is next to include a catalyst comprising a colloidal suspension or amine salt of transition/alkali/alkaline earth metal coordinations having at least one metal oxide-hydroxide linked to an alkyl chain via a carboxyl group. The hydrocarbon structure of the catalyst is selected in order to generate a high resistance coefficient to the nitrated components as well as to the active oxidizers found in the composition. It is suggested that sodium and potassium are the preferred alkali metals to be used herein although lithium, rubidium, cesium and francium can also be employed. The catalyst is to be included within the entire composition in an amount between approximately 250 ppm to 30% (by weight) or more, and preferably between approximately 500 ppm to 15% (by weight).

Transition metals which may be employed in the catalyst component are mainly those from the first two series of the Periodic Table including, but not limited to, titanium, chromium, manganese, nickel, copper and molybdenum. However, it is possible to also use elements derived from other groups in the periodic table, namely, zinc, boron and aluminum.

The applicable alkaline earth metals for use in the catalyst component include magnesium, calcium and barium, although it was found that elements of the carbon group such as tin and lead and minor amounts of sulfur could also be incorporated within the catalyst component.

It is preferred that the amine salt component of the catalyst comprise the reaction product of one or more of the above-recited alkaline metals or boron group elements with one or more members selected from the group consisting of methyl-, trimethyl- and tetramethyl ethylene diamines.

When the catalyst composition is a colloidal suspension, it is preferred that the colloidal suspension be derived from the reaction of a monocarboxylic acid having 1 to 30 carbon atoms with a member selected from the group consisting of transition metals, zinc, alkaline earth metals, tin, lead and sulfur. The preferred monocarboxylic acids include those containing 1 to 30 carbon atoms with the more preferred range being from 5 to 18 carbon atoms while the most preferred range, 5 to 9 carbon atoms. Saturated and unsaturated fatty acids can be employed as well as synthetic organic acids. Included within this group are monocarboxylic acids in the $C_3$–$C_4$, $C_9$, $C_{18}$, range as well as tall oil acid, versatic acid, 2-ethylhexoic, 3,5,5-trimethylhexoic acid and mixtures thereof.

The solvent component of the composition comprises a hydrocarbon or hydrocarbons containing oxygen such as alkanol-aliphatic ethers. It is to be employed within the composition in an amount between approximately 5.0 to 65.0% (by weight) and preferably between approximately 5.0 to 30% (by weight).

It is believed that the nature of, for example, the hydrocarbon used as a solvent is not critical. It may be paraffin, naphtene, an olefin, an aromatic or mixtures of all of these components. The solvent may be quite volatile which is the case when a material such as pentane is employed or may be a high boiling fraction of a lubricating oil. Mixtures of hydrocarbons such as gasoline fractions are often preferred or oxygenated blends using a catalyst as a peptizing agent.

As previously noted, the present composition is also intended to include a promoter which comprises a member selected from the group consisting of an organic oxide and optionally a co-promoter comprising an organic oxide azeotroped with one or more alkanes. When an azeotrope is formed, it is preferable that the organic oxide be azeotroped with carbon disulfide dispersed in a hydrocarbon stream wherein said hydrocarbon stream comprises one or more members selected from the group consisting of n-alkanes and cycloparaffins. The organic oxide is intended to include, but not be limited to, methyl-, ethyl-, butyl- and propyl- alkyl groups and mixtures of these alkyl groups including, but not limited to, methyl-ethyl, methyl-butyl, etc., either taken alone or combined with a polyether. Preferably, the promoter comprises an organic oxide having ethyl or propyl alkyl groups thereon. It is preferred that when an azeotrope is formed with carbon disulfide that it be dispersed in a hydrocarbon stream chiefly comprising an n-alkane and/or cycloparaffin having 2 to 9 carbon atoms and preferably 5 to 8 carbon atoms.

It is also optionally advantageous to employ an alternative promoter comprising an organic ester. Organic esters for use herein include, but are not limited to, butyl acetate and a member selected from the group consisting of methanol, ethanol and butanol. When used, the promoter, co-promoter and alternative promoter can be employed in the present invention in an amount between approximately 0.1 to 10.0% (by weight) and preferably between approximately 2.0 to 5.0% (by weight).

EXAMPLE 1

A mixed polyamine, namely, Lubrizol 8150, was dispersed into N-methyl-phenylamine at weight ratio of 1 part polyamine to 24 parts phenylamine.

Approximately 19 parts by weight of the polyamine-phenylamine mixture was combined with approximately 1 part by weight of the appropriate polymeric substrate. This substrate comprised approximately 60.0 percent (wt.) of styrene monomer, approximately 25.0 percent (wt.) ethylbenzene and approximately 15.0 percent (wt.) of partially polymerized styrene monomer dispersed in equal parts by weight of a solvent. The solvent comprised naphtha containing approximately 14.62 percent (wt.) xylene with an ortho to para weight ratio of approximately 3:1, the meta to para weight ratio being approximately 3.65:1. It was noted that the solvent boiled at approximately 160° IBP having an EP of approximately 180° C. Approximately 5.0 percent (wt.) of the polymeric substrate was comprised of a mixture of hindered phenols and the phenylene diamine component comprised approximately 70.0 percent (wt.) N,N-di-secondary butyl para-phenylene diamine in 30.0 percent (wt.) Lubrizol 817 which is a hindered phenol-type product.

EXAMPLE 2

Approximately 80.0 percent (wt.) of the composition of Example 1 was added to approximately 5.0 percent (wt.) of a catalyst. The catalyst component which was used is one which is commercially available from DG Chemie of Wuppertal, Germany, sold under its trade designation DG-247-C, which is a low aminated barium-sulphur, sodium alkanol naphtenic solute with low acid to neutral pH. To this was added approximately 15.0 percent (wt.) of a common alkanol, namely, methanol.

The catalyst was added to the composition as a "catalyst concentrate." The catalyst concentrate was prepared by mixing approximately 7.0 percent (wt.) of the component referred to previously as being available from DG Chemie of Wuppertal, Germany with approximately 28 percent (wt.) of a naphthenic straight mineral oil available from Exxon Co. and sold under the trade name Coray 15. To this was added approximately 35.0 percent (wt.) n-hexane, approximately 10.0 percent (wt.) n-butanol and approximately 20.0 percent (wt.) of a petroleum ether boiling at approximately 30° IBP and having an EP of approximately 60° C.

EXAMPLE 3

The same polyamine and phenylamine employed in Example 1 were now combined whereby approximately 60.0 percent (wt.) of the polyamine was added to approximately 40.0 percent (wt.) of the phenylamine. The same polymeric substrate of Example 1 was used employing the same hindered phenols and phenylamine diamine components. However, in this example, approximately 70.0 percent (wt.) of the hindered phenol component, namely, Lubrizol 817 was used with approximately 30.0 percent (wt.) of N,N-di-secondary butyl para-phenylene diamine.

EXAMPLE 4

The composition of Example 3 was combined, at a weight ratio of approximately 1:1 with a solvent comprising approximately 30 percent (wt.) of a mixed alkanol solution comprising isobutanol and isopropanol mixed at a ratio of approximately 2 parts isobutanol to one part isopropanol with approximately 60 percent (wt.) propylene oxide.

Approximately 10.0 percent (wt.) of the solvent comprised the "catalyst component" which was formulated from approximately 27.0 percent (wt.) DG-217-C solution combined as a ratio of one part of such solution to 2 parts by weight of a premium gasoline obtained from Texaco-Belgium (Antwerp). Approximately 70.0 percent (wt.) of the "catalyst component" comprised the combination of 15.0 percent (wt.) methanol and 85 percent (wt.) of 99+ percent 2-propanone forming an azeotropic combination and approximately 3.0 percent (wt.) of the combination of 1 part Lubrizol 8150 (polyamine) with 2 parts by weight isobutanol.

EXAMPLE 5

A mixed polyamine, namely Lubrizol 8150, was dispersed into N-methyl-phenylamine at a weight ratio of 1 part polyamine to 24 parts phenylamine. Four parts of this mixture was then added to 1 part by weight of the promoter/solvent methyl tertiarybutyl ether. To this solution was added the "catalyst component" comprising 15.0 percent (wt.) of DG Chemie's DG-218-C which itself includes 63.5 percent (wt.) of the catalyst DG-217-C and approximately 37.5 percent (wt.) of the naphthenic solvent Coray 15. The "catalyst component" also includes approximately 15 percent (wt.) of Lubrizol 8164, which is a detergent inhibited valve seat lubricant containing apart from its hydrocarbon elements, the elements sodium and sulfur, approximately 20.0 percent (wt.) n-heptane, approximately 40.0 percent (wt.) of petroleum ether boiling at approximately 30° IBP having an EP of approximately 60° C. with approximately 10.0 percent (wt.) n-butanol.

EXAMPLE 6

The composition of Example 5 was altered by substituting the previously employed promoter MTBE with a carbon disulfide azeotroped organic oxide. More specifically, the alternative promoter comprised approximately 5.0 percent (wt.) based upon the total weight of the composition of carbon disulfide azeotroped with ethyl oxide and the alkane, dry pentane. The MTBE promoter of Example 5 was replaced in equal weight amounts by the alternative promoter which contained one part of the carbon disulfide azeotroped ethyl oxide to 1.5 parts by weight of the dry pentane.

EXAMPLE 7

The composition of Example 5 was again prepared. However, now, the promoter which previously comprised MTBE was replaced with a co-promoter, namely, the organic ester, t-butyl acetate. The co-promoter was employed in an amount approximately 5.0 percent (wt.) calculated on a total weight basis of the composition.

EXAMPLE 8

The composition of Example 6 was duplicated whereby a co-promoter, an organic ester, was employed in addition to the promoter of Example 6. As in the previous example, the organic ester employed was t-butyl acetate. The amount of promoter and co-promoter remained constant with respect to the amount of catalyst employed.

I claim:

1. A composition for the improvement of hydrocarbon fuels exhibiting a boiling range of gasoline being suitable for use in spark ignition-type engines comprising:

a. an aromatic amine;

b. a polyaminated detergent;

c. a catalyst comprising a colloidal suspension or amine salt of transition/alkali/alkaline earth metal organic coordinations having at least one metal oxidehydroxide linked to an alkyl chain via a carboxyl group; and d. a solvent comprising an alkanol-aliphatic ether oxygenated hydrocarbon.

2. The composition of claim 1 wherein said aromatic amine comprises one or more members selected from the group consisting of methyl-, dimethyl-, trimethyl-, methoxy-, ethyl-, butyl-, propyl-, isobutyl-, fluoro-, chloro-, bromo-, iodo-, difluoro-, dichloro- and diiodophenylamines, and mixtures thereof.

3. The composition of claim 1 wherein said polyaminated detergent comprises one or more members selected from the group consisting of polypropylene and polyisobutene succinic polyalkene amines; substituted benzylpolyamines; acylated polyalkylene amine-polyolefins; hydrocarbon polyether-substituted succinamic acid compounds; reaction products of polyethers and maleic anhydride; reaction products of polyethers and asparagine; primary aliphatic hydrocarbon aminoalkene substituted asparagines; ω-N-disubstituted amino alkanoic acid; N'-amides; alkyl and hydroxy-substituted benzyl polyamines, and mixtures thereof.

4. The composition of claim 1 wherein said alkali metals comprise one or more members selected from the group consisting of lithium, sodium, potassium, rubidium, cesium and francium.

5. The composition of claim 1 wherein said transition metals comprise one or more members selected from the group consisting of titanium, chromium, manganese, nickel, copper, molybdenum, zinc, boron and aluminum.

6. The composition of claim 1 wherein said alkaline earth metals comprise one or more members selected from the group consisting of magnesium, calcium, barium, tin, lead and sulfur.

7. The composition of claim 1 wherein said amine salt comprises the reaction product of said alkali metal or boron group elements with one or more members selected from the group consisting of methyl-, trimethyl- and tetramethyl-ethylene diamines.

8. The composition of claim 1 wherein said amine salt comprises the reaction product of said alkali metal or boron group elements with transitional elements and with one or more members selected from the group consisting of methyl-, trimethyl-, and tetramethyl-ethylene diamines.

9. The composition of claim 1 wherein said colloidal suspension is derived from the reaction of a monocarboxylic acid having one to thirty carbon atoms with a member selected from the group consisting of transition metals, zinc, alkaline earth metals, tin, lead and sulfur.

10. The composition of claim 1 wherein said solvent comprises one or more members selected from the group consisting of hydrocarbons and hydrocarbon oxygenates and mixtures thereof.

11. The composition of claim 1 further comprising an alkyl- or phenyl- or alkylphenyl-phenylenediamine inhibited aromatic monomer.

12. The composition of claim 1 further comprising a promoter comprising a member selected from the group consisting of an organic oxide and an organic oxide azeotroped with carbon disulfide with one or more alkanes.

13. The composition of claim 1 further comprising a co-promoter comprising an organic ester.

14. The composition of claim 12 wherein said promotor comprises an organic oxide having ethyl or propyl alkyl groups thereon.

15. The composition of claim 12 wherein said promoter comprises an organic oxide azeotroped with carbon disulfide dispersed in a hydrocarbon stream wherein said hydrocarbon stream comprises one or more members selected from the group consisting of n-alkanes and cycloparaffins.

16. The composition of claim 13 wherein said copromoter comprises butyl acetate and a member selected from the group consisting of methanol, ethanol and butanol.

17. The composition of claim 1 wherein said amine and polyaminated detergent are present in said composition within the range of 99 parts by weight amine to 1 part by weight polyaminated detergent to 2 parts by weight polyaminated detergent to 1 part by weight amine.

18. The composition of claim 1 wherein said amine and polyaminated detergent comprise approximately 5.0 to 85% by weight of the entire composition.

19. The composition of claim 1 wherein said amine and polyaminated detergent comprise approximately at least 40% weight of the entire composition.

20. The composition of claim 11 wherein said alkyl- or phenyl- or alkylphenyl- phenylenediamine inhibited aromatic monomer is stabilized by a polymeric substrate.

21. The composition of claim 20 wherein said polymeric substrate comprises polymers prepared from one or more monomers selected from the group consisting of styrene, α-methyl styrene and $C_{1-4}$ alkyl and alkoxy ring substituted styrenes.

22. The composition of claim 12 wherein the organic oxide is methyl tertiarybutyl ether.

23. A composition of matter comprising:

a. a hydrocarbon fuel exhibiting a boiling range of gasoline;

b. an aromatic amine;

c. a polyaminated detergent;

d. a catalyst comprising a colloidal suspension or amine salt of transition/alkali/alkaline earth metal organic coordinations having at least one metal oxidehydroxide linked to an alkyl chain via a carboxyl group; and e. a solvent comprising an alkanolaliphatic ether oxygenated hydrocarbon.

24. The composition of claim 23 wherein said hydrocarbon fuel is one or more members selected from the group consisting of gasoline, gasohol and alcogas.

25. The composition of claim 1 wherein the aromatic amine is N-methyl-phenylamine.

26. A method for producing a hydrocarbon fuel having improved anti-knock and lubrication characteristics, comprising the steps of:

(a) dispersing a polyaminated detergent into and amine to form a mixture;

(b) adding a catalyst to said mixture, said catalyst comprising a colloidal suspension or amine salt of transistion/alkali/alkaline earth metal organic coordinations having at least one metal oxide-hydroxide linked to an alkyl chain via a carboxyl group;

(c) adding a solvent comprising an alkanolaliphatic ether oxygenated hydrocarbon to produce an additive; and (d) combining said additive with a hydrocarbon exhibiting a boiling range of gasoline being suitable for use in spark ignition-type engines.

27. The method of claim 26 wherein said hydrocarbon fuel is one or more members selected from the group consisting of gasoline, gasohol and alcogas.

28. The method of claim 26 further comprising the step of:

(e) adding an alkyl- or phenyl- or alkylphenylenediamine inhibited aromatic monomer to said mixture prior to said step of adding said catalyst to said mixture.

29. The method of claim 28 further comprising the step of:

(f) stabilizing said alkyl- or phenyl- or alkylphenylenediamine inhibited monomer by a polymeric substrate.

30. The method of claim 29 wherein said polymeric substrate comprises polymers prepared from one or more monomers selected from the group consisting of styrene, α-methyl styrene and $C_{1-4}$ alkyl and alkoxyy ring substituted styrenes.

31. The method of claim 26 wherein said amine comprises one or more members selected from the group consisting of aromatic amines; methyl-, trimethy- and tetra methyl-alkylated forms of ethylene diamines; primary alkyl fatty amines; alkyl ether propylamines; ether diamines; alkylpropylene diamines; methyl-, dimethyl-, trimethyl-, methoxy-, ethyl-, butyl-, propyl-, isobutyl-, fluoro-, chloro-, bromo-, iodo-, difluoro-, dichloro- and diiodo-phenylamines, and mixtures thereof.

32. The method of claim 26 wherein said polyaminated detergent comprises one or more members selected from the group consisting of polypropylene and polyisobutene succinic polyalkene amines; substituted benzylpolyamines; acylated polyakylene amine-polyolefins; hydrocarbon polyether-substituted succinamic acid compounds; reaction products of polyethers and maleic anhydride; reaction products of polyethers and asparagine; primary aliphatic hydrocarbon aminoalkene substituted asparagines; phi-N-disubstituted amino alkanoic acid; N'-amides; alkyl and hydroxy-substituted benzyl polyamines, and mixtures thereof.

33. The method of claim 26 wherein said transition metal comprises one or more members selected from the group consisting of titanium, chromium, manganese, nickel, copper, molybdenum, zinc, boron and aluminum.

34. The method of claim 26 wherein said alkaline earth metals comprise one or more members selected from the group consisting of magnesium, calcium, barium, tin, lead and sulfur.

35. The method of claim 26 wherein said amine salt comprises the reaction product of said alkali metal or boron group elements with one or more members selected from the group consisting of methyl-, trimethyl- and tetramethyl-ethylene diamines.

36. The method of claim 26 further comprising the step of:

(e) adding a promotor comprising a member selected from the group consisting of an organic oxide and an organic oxide azeotroped with carbon disulfide with one or more alkanes, said promotor being added prior to said step of adding said catalyst.

37. The methods of claims 26 or 36 further comprising the step of:

(f) adding a co-promotor comprising an organic ester prior to said step of adding said catalyst.

38. The method of claim 36 wherein said promotor comprises an organic oxide having ethyl or propyl alkyl groups thereon.

39. The method of claim 36 wherein said promoter comprises an organic oxide azeotroped with carbon disulfide dispersed in a hydrocarbon stream wherein said hydrocarbon stream comprises one or more members selected from the group consisting of n-alkanes and cycloparaffins.

40. The method of claim 37 wherein said co-promoter comprises butyl acetate and a member selected from the group consisting of methanol, ethanol and butanol.

41. The method of claim 26 wherein said polyaminated detergent is dispersed in said amine in a ratio within the range of 1 part by weight polyaminated detergent to 99 parts by weight amine to 2 parts by weight polyaminated detergent to 1 part by weight amine.

42. The method of claim 26 wherein said amine and polyaminated detergent comprise approximately 5% to 85% by weight of said additive.

43. The method of claim 26 wherein said amine and polyaminated detergent comprise approximately at least 40% by weight of said additive.

* * * * *